US012708149B2

(12) United States Patent
Zhou

(10) Patent No.: US 12,708,149 B2
(45) Date of Patent: Aug. 18, 2026

(54) VAPORIZER AND ELECTRONIC VAPORIZATION DEVICE

(71) Applicant: SHENZHEN SMOORE TECHNOLOGY LIMITED, Shenzhen (CN)

(72) Inventor: Jianguang Zhou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 542 days.

(21) Appl. No.: 18/334,281

(22) Filed: Jun. 13, 2023

(65) Prior Publication Data

US 2023/0404160 A1 Dec. 21, 2023

(30) Foreign Application Priority Data

Jun. 20, 2022 (CN) ..... 202221551065.1

(51) Int. Cl.
*A24F 40/485* (2020.01)
*A24F 40/10* (2020.01)
*A24F 40/42* (2020.01)

(52) U.S. Cl.
CPC ..... *A24F 40/485* (2020.01); *A24F 40/10* (2020.01); *A24F 40/42* (2020.01)

(58) Field of Classification Search
CPC ..... A24F 40/10; A24F 40/42; A24F 40/485
See application file for complete search history.

(56) References Cited

U.S. PATENT DOCUMENTS

2015/0366265 A1* 12/2015 Lansing ..... A24D 3/17 131/329
2021/0153551 A1* 5/2021 Liu ..... A24F 40/485

FOREIGN PATENT DOCUMENTS

CN 110122932 A 8/2019
CN 211129735 U 7/2020

OTHER PUBLICATIONS

Canadian Intellectual Property Office, Office Action in Canadian Patent Application No. 3, 199,613 (Nov. 15, 2024).

* cited by examiner

*Primary Examiner* — Katelyn W Smith
(74) *Attorney, Agent, or Firm* — Leydig, Voit & Mayer, Ltd.

(57) ABSTRACT

A vaporizer includes: a shell having a liquid storage cavity; a suction nozzle having a suction nozzle opening, the suction nozzle being connected to the shell; a vaporization air tube passing through the liquid storage cavity and having an inhalation channel in communication with the suction nozzle opening; and a start air tube passing through the liquid storage cavity, the start air tube being detachably arranged, an end of the start air tube close to the suction nozzle opening being in communication with an end of the inhalation channel close to the suction nozzle opening. An end of the inhalation channel far from the suction nozzle opening is in communication with external atmosphere. An end of the start air tube far away from the suction nozzle opening communicates with a pneumatic switch on the main unit. The start air tube is in communication with a channel of the pneumatic switch.

9 Claims, 5 Drawing Sheets

VAPORIZER AND ELECTRONIC VAPORIZATION DEVICE

CROSS-REFERENCE TO PRIOR APPLICATION

Priority is claimed to Chinese Patent Application No. 202221551065.1, filed on Jun. 20, 2022, the entire disclosure of which is hereby incorporated by reference herein.

FIELD

This application relates to the field of vaporization technologies, and in particular, to a vaporizer and an electronic vaporization device.

BACKGROUND

An existing electronic vaporization device usually includes a detachable main unit and a vaporizer. A cell is arranged inside the main unit, and is configured to supply power to the vaporizer. Generally, a start switch, such as a microphone, is arranged on the main unit, to start, when a user inhales and uses the electronic vaporization device, the main unit for supplying power to the vaporizer.

However, in the existing electronic vaporization device, a start airway in communication with the microphone is usually in direct communication with an air inlet groove at the end of the main unit facing toward the vaporizer, and air from the outside flows into an inhalation channel inside the vaporizer through the air inlet groove. Therefore, if liquid, such as condensate, exists in the inhalation channel, the liquid is very likely to enter the start airway and cause damage to the microphone. Moreover, once the inhalation channel is blocked by a vaporizable substrate with high viscosity, the electronic vaporization device is very likely to fail and be scrapped, resulting in a high failure rate of existing electronic vaporization devices.

SUMMARY

In an embodiment, the present invention provides a vaporizer, comprising: a shell comprising a liquid storage cavity; a suction nozzle comprising a suction nozzle opening, the suction nozzle being connected to the shell; a vaporization air tube passing through the liquid storage cavity and comprising an inhalation channel in communication with the suction nozzle opening; and a start air tube passing through the liquid storage cavity, the start air tube being detachably arranged, an end of the start air tube close to the suction nozzle opening being in communication with an end of the inhalation channel close to the suction nozzle opening, wherein an end of the inhalation channel far away from the suction nozzle opening is in communication with external atmosphere, wherein an end of the start air tube far away from the suction nozzle opening is configured to communicate with a pneumatic switch on the main unit, and wherein the start air tube is in communication with a channel of the pneumatic switch and is isolated from a channel of the inhalation channel in communication with the external atmosphere.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
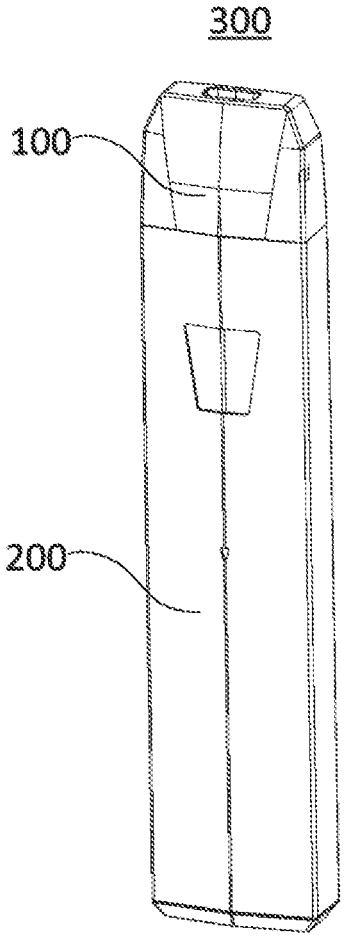
FIG. 1 is a schematic structural diagram of an embodiment of an electronic vaporization device according to this application.

In an embodiment, the present invention provides a vaporizer and an electronic vaporization device, to resolve the problem that blockage of an inhalation channel of the electronic vaporization device easily leads to scrapping of the electronic vaporization device.

In an embodiment, the present invention provides a vaporizer. The vaporizer includes a shell, provided with a liquid storage cavity; a suction nozzle, provided with a suction nozzle opening and connected to the shell; a vaporization air tube, passing through the liquid storage cavity and provided with an inhalation channel in communication with the suction nozzle opening; and a start air tube, passing through the liquid storage cavity, where the start air tube is detachably arranged, and the end of the start air tube close to the suction nozzle opening is in communication with the end of the inhalation channel close to the suction nozzle opening; and the end of the inhalation channel far away from the suction nozzle opening is in communication with the external atmosphere, the end of the start air tube far away from the suction nozzle opening is configured to communicate with a pneumatic switch on the main unit, and the channel through which the inhalation channel communicates with the external atmosphere is isolated from the channel through which the start air tube communicates with the pneumatic switch.

In some embodiments, the start air tube is a metal tube.

In some embodiments, the tube diameter of the start air tube is greater than or equal to 0.6 mm and less than or equal to 2.0 mm, and the wall thickness of the start air tube is greater than or equal to 0.1 mm and less than or equal to 0.3 mm.

In some embodiments, the two ends of the vaporization air tube are connected to the two ends of the shell respectively, and the start air tube is detachably connected to the two ends of the shell, where the suction nozzle and an end of the shell form a communication airway, and the communication airway is in communication with the vaporization air tube and the end of the start air tube close to the suction nozzle.

In some embodiments, the start air tube is connected to the two ends of the shell in an interference-fit manner; or the start air tube is connected to the two ends of the shell in a screwed connection manner.

In some embodiments, the end surface of the end of the start air tube close to the suction nozzle opening is higher than the end surface of the end of the shell close to the suction nozzle opening.

In some embodiments, the height difference between the end surface of the end of the start air tube close to the suction nozzle opening and the end surface of the end of the shell close to the suction nozzle opening is greater than or equal to 0.1 mm.

In some embodiments, the suction nozzle includes a first housing and a second housing arranged on the inner side of the first housing, a cavity is formed between the first housing and the second housing, the second housing is provided with the suction nozzle opening, and at least one transition opening communicating with the cavity and the suction nozzle opening is formed at the end of the second housing and/or the shell close to the suction nozzle opening;

the first housing is detachably connected to the shell, and an end of the shell covers the cavity, to define and form the communication airway; and the end of the start air tube close to the suction nozzle opening extends into the cavity.

In some embodiments, the vaporizer further includes an elastic base, the elastic base is provided with a first vent hole and a second vent hole that are isolated from each other, the elastic base is connected to the end of the shell far away from the suction nozzle opening, the first vent hole is in communication with the port of the vaporization air tube far away from the suction nozzle opening, and the second vent hole is in communication with the port of the start air tube far away from the suction nozzle opening; and the end of the elastic base facing away from the suction nozzle opening is elastically abutted against the main unit, to isolate the first vent hole and the second vent hole.

In some embodiments, at least one isolation rib is arranged at the end of the elastic base facing away from the suction nozzle opening, and the isolation rib is arranged around at least one of the first vent hole or the second vent hole.

In some embodiments, a sleeve portion and an accommodating groove arranged on one side of the sleeve portion are arranged at the end of the shell facing away from the suction nozzle opening, and the end of the vaporization air tube is connected to the inner side of the sleeve portion, and the end of the start air tube is in communication with the accommodating groove; and the elastic base includes a sealing sleeve and an accommodating portion connected to a side of the sealing sleeve, the sealing sleeve is provided with the first vent hole, the accommodating portion is provided with the second vent hole, the sealing sleeve extends into the sleeve portion and is arranged and sealed with the inner wall of the vaporization air tube and the inner wall of the sleeve portion, and at least a part of the accommodating portion is accommodated in the accommodating groove and is arranged and sealed with the groove walls of the accommodating groove.

In order to resolve the technical problem, another technical solution adopted by this application is to provide an electronic vaporization device. The electronic vaporization device includes a main unit and the vaporizer as stated above, where the main unit is connected to the vaporizer, to make the end of the start air tube far away from the suction nozzle opening in communication with the pneumatic switch on the main unit.

Beneficial effects of this application are as follows: different from the related art, this application discloses a vaporizer and an electronic vaporization device. In this application, an independent start air tube passing through a liquid storage cavity of a shell is arranged, to form a start airway that is not shared with an inhalation channel, to prevent that a vaporizer cannot be started after the inhalation channel is blocked. In addition, the end of the start air tube close to a suction nozzle opening is in communication with the end of the inhalation channel close to the suction nozzle opening, that is, the start air tube is also in direct communication with the suction nozzle opening. Moreover, this part is located on the side of the liquid storage cavity close to the suction nozzle opening, and being close to the suction nozzle opening prevents the position from being easily blocked by aerosol condensate. Therefore, even if the inhalation channel is blocked, during inhalation, a user can still start the vaporizer through the start air tube for heating. After the heating is started, a vaporization core inside the inhalation channel heats up for vaporization, which can reduce the viscosity of a vaporizable substrate that blocks the inhalation channel to make the vaporizable substrate flow away or vaporized. Therefore, the bad situation that inhalation channel is blocked can be eliminated, to enable the vaporizer to return to normal and continue to be used, thereby improving the reliability of the vaporizer. In addition, compared with the existing solution that a liquid storage cavity, a inhalation channel, and a start airway are directly formed on a housing of vaporizer, this application defines that the start air tube is detachably arranged, that is, the start air tube can be independently manufactured as a separate component, so that the start air tube can be miniaturized, which can significantly reduce the manufacturing difficulty of other components in the vaporizer and improve the yield rate of the vaporizer. In addition, the miniaturized start air tube occupies less space in the liquid storage cavity, and has less impact on the capacity of the liquid storage cavity.

The technical solutions in embodiments of this application are clearly and completely described below with reference to the accompanying drawings in the embodiments of this application. Apparently, the described embodiments are merely some rather than all of the embodiments of this application. All other embodiments obtained by a person of ordinary skill in the art based on the embodiments of this application without creative efforts shall fall within the protection scope of this application.

The terms "first", "second", and "third" in the embodiments of this application are merely intended for a purpose of description, and shall not be understood as an indication or implication of relative importance or implicit indication of the number of indicated technical features. Therefore, features defining "first", "second", and "third" can explicitly or implicitly include at least one of the features. In the description of this application, "a plurality of" means at least two, such as two and three unless it is specifically defined otherwise. In addition, terminologies "include", "have", and any variations thereof are intended to indicate non-exclusive inclusion. For example, a process, method, system, product, or device that includes a series of steps or units is not limited to the listed steps or units; and instead, further optionally includes a step or unit that is not listed, or further optionally includes another step or unit that is intrinsic to the process, method, product, or device.

"Embodiment" mentioned in this specification means that particular features, structures, or characteristics described with reference to the embodiment may be included in at least one embodiment of this application. The term appearing at different positions of the specification may not refer to the same embodiment or an independent or alternative embodiment that is mutually exclusive with another embodiment. A person skilled in the art explicitly or implicitly understands that the embodiments described in the specification may be combined with other embodiments.

Figure 2:
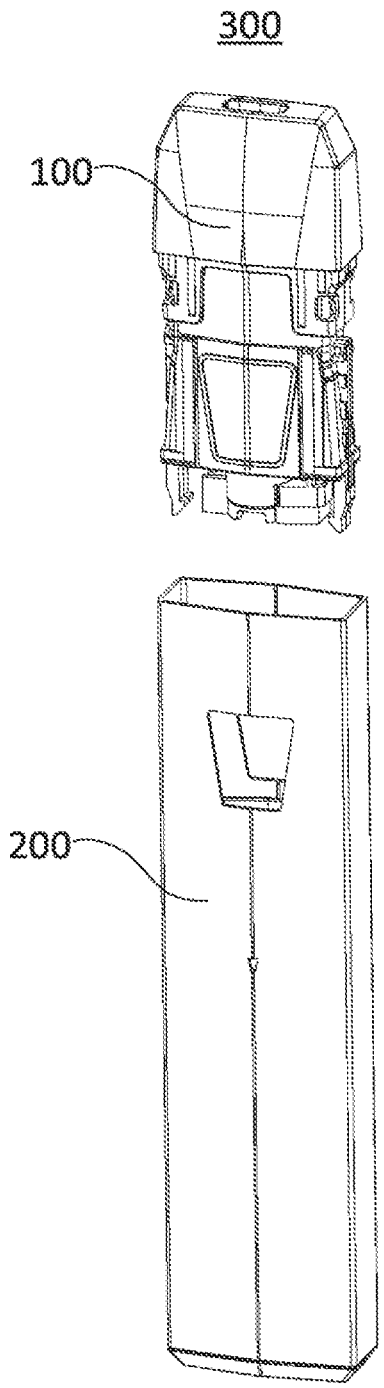
FIG. 2 is a schematic exploded structural view of the electronic vaporization device shown in FIG. 1.
Figure 3:
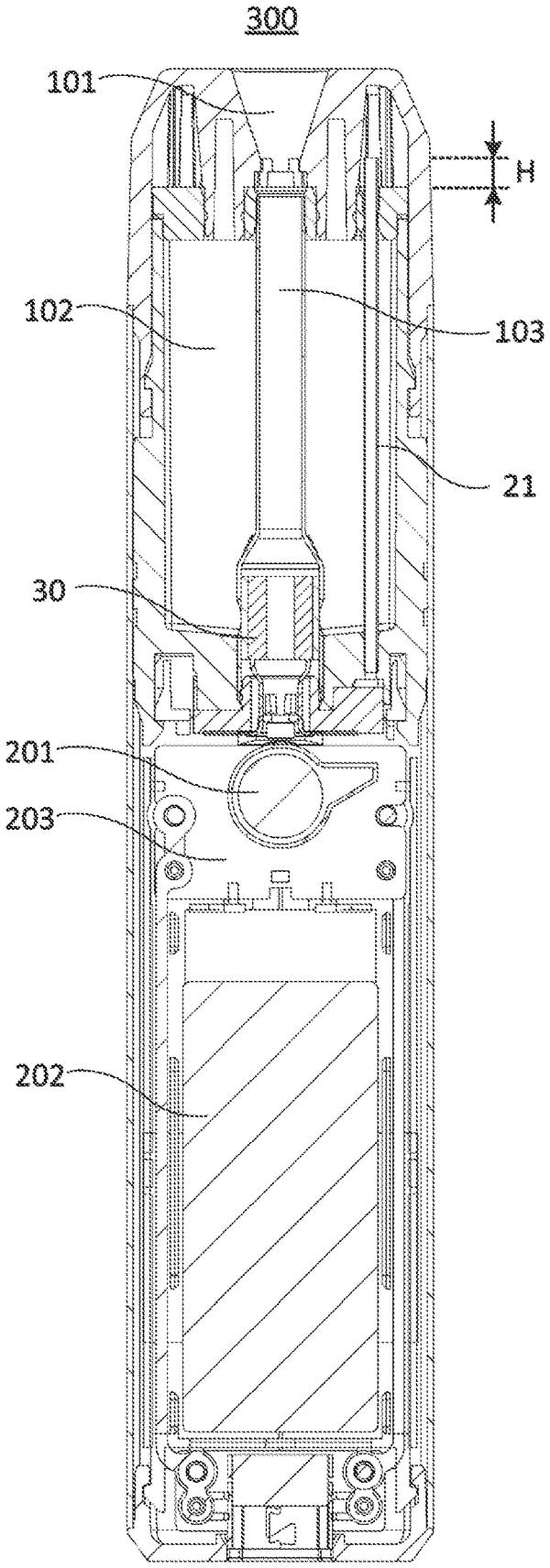
FIG. 3 is a schematic cross-sectional structural view of the electronic vaporization device shown in FIG. 1.

This application provides an electronic vaporization device 300. Referring to FIG. 1 to FIG. 3, FIG. 1 is a schematic structural diagram of an embodiment of an electronic vaporization device according to this application, FIG. 2 is a schematic exploded structural view of the electronic vaporization device shown in FIG. 1, and FIG. 3 is a schematic cross-sectional structural view of the electronic vaporization device shown in FIG. 1.

The electronic vaporization device 300 includes a vaporizer 100 and a main unit 200. The main unit 200 may be detachably connected to the vaporizer 100. That is, the electronic vaporization device 300 may be a split device.

Alternatively, the main unit 200 is non-detachably connected to the vaporizer 100. That is, the electronic vaporization device 300 is an integrated device. For example, the vaporizer part and the main unit part share some components.

The main unit 200 includes a battery 202, a start switch 201, and a control device 203. The control device 203 is electrically connected to the battery 202 and the start switch 201, and is configured to supply power to the vaporizer 100. The start switch 201 may be a microphone, an air pressure sensor, or the like. The start switch 201 transmits a signal to the control device 203 when sensing inhalation of a user. The control device 203 starts the main unit 200 based on the signal for supplying power to the vaporizer 100, so as to provide energy required by vaporization of the vaporizer 100. When the signal disappears or changes, the control device 203 stops supplying power to the vaporizer 100.

As shown in FIG. 1 to FIG. 3, the vaporizer 100 includes a suction nozzle opening 101, a liquid storage cavity 102, an inhalation channel 103 passing through the liquid storage cavity 102 and being in communication with the suction nozzle opening 101, and a start air tube 21 passing through the liquid storage cavity 102. The start air tube 21 is detachably arranged, and the end of the start air tube 21 close to the suction nozzle opening 101 is in communication with the end of the inhalation channel 103 close to the suction nozzle opening 101. The end of the inhalation channel 103 far away from the suction nozzle opening 101 is in communication with the external atmosphere, the end of the start air tube 21 far away from the suction nozzle opening 101 is configured to communicate with the start switch 201 on the main unit 200, and the channel through which the inhalation channel 103 communicates with the external atmosphere is isolated from the channel through which the start air tube 21 communicates with the start switch 201, that is, the two channels are independent of each other.

In an embodiment, the vaporizer 100 may include a main body and a start air tube 21. The main body is an integrated structure, in which a suction nozzle opening 101, a liquid storage cavity 102, and an inhalation channel 103 are formed, and a channel communicating the start air tube 21 with the end of the inhalation channel 103 close to the suction nozzle opening 101 is further formed. Alternatively, the end of the start air tube 21 close to the suction nozzle opening 101 is in direct communication with the end of the inhalation channel 103 close to the suction nozzle opening 101, and the start air tube 21 is detachably connected to the main body, and passes through the liquid storage cavity 102.

In another embodiment, the vaporizer 100 may include a main body, an end cap, and a start air tube 21. The main body is an integrated structure, in which a suction nozzle opening 101, an accommodating space, and an inhalation channel 103 are formed. The end cap is detachably connected to an end of the main body, to cover the accommodating space, define a liquid storage cavity 102, and further connect to an end of the inhalation channel 103. An end of the start air tube 21 passes through the accommodating space to be detachably connected to the other end of the main body, and the other end of the start air tube 21 is detachably connected to the end cap.

The vaporizer 100 may also be another structure, which is not exemplified in this application. All structures fall within the protection scope of this application provided that the structures conform to the range defined by the vaporizer 100.

The vaporizer 100 is connected to the main unit 200, so that the end of the start air tube 21 far away from the suction nozzle opening 101 communicates with the start switch 201 on the main unit 200. The inhalation channel 103 can communicate with the external atmosphere through the main unit 200 or can communicate with the external atmosphere without the assistance of the main unit 200.

In this application, an independent start air tube 21 passing through a liquid storage cavity 102 is arranged, to form a start airway that is not shared with an inhalation channel 103, to prevent that a vaporizer 100 cannot be started after the inhalation channel 103 is blocked. In addition, the end of the start air tube 21 close to a suction nozzle opening 101 is in communication with the end of the inhalation channel 103 close to the suction nozzle opening 101, that is, the start air tube 21 is also in direct communication with the suction nozzle opening 101. Moreover, this part is located on the side of the liquid storage cavity 102 close to the suction nozzle opening 101, and being close to the suction nozzle opening 101 prevents the position from being easily blocked by aerosol condensate. Therefore, even if the inhalation channel 103 is blocked, during inhalation, a user can still start the vaporizer 100 through the start air tube 21 for heating. After the heating is started, a vaporization core 30 inside the inhalation channel 103 heats up for vaporization, which can reduce the viscosity of a vaporizable substrate that blocks the inhalation channel 103 to make the vaporizable substrate flow away or vaporized. Therefore, the bad situation that inhalation channel 103 is blocked can be eliminated, to enable the vaporizer 100 to return to normal and continue to be used, thereby improving the reliability of the vaporizer 100.

In the existing solutions, usually, a liquid storage cavity, an inhalation channel, and a start airway are directly formed in a housing of a vaporizer, resulting in high difficulty and complex processes of mold making of the housing. To improve the yield rate of mold making, usually, the pore size of the start airway is made larger, and the pore size reaches 2 mm or more. To ensure the strength of the pore wall of the start airway, the wall thickness is also larger, and the wall thickness reaches 0.5 mm or more. However, during trial production of a module, a needle on a mold is likely to be crooked during high-temperature gel filling, resulting in a high risk and a poor yield rate. In addition, because of the large pore size and wall thickness of the start airway, the start airway occupies a large volume inside the liquid storage cavity, which consequently, further exerts serious impact on the capacity of the liquid storage cavity.

Compared with the existing solution that a liquid storage cavity, a inhalation channel, and a start airway are directly formed on a housing of vaporizer, this application defines that the start air tube 21 is detachably arranged, that is, the start air tube 21 can be independently manufactured as a separate component, so that the start air tube can be miniaturized, which can significantly reduce the manufacturing difficulty of other components in the vaporizer 100 and improve the yield rate of the vaporizer 100. In addition, the miniaturized start air tube 21 occupies less space in the liquid storage cavity 102, and has less impact on the capacity of the liquid storage cavity 102.

In this embodiment, the start air tube 21 is a metal tube, for example, a stainless steel tube, an aluminum alloy tube, or a titanium alloy tube, which has high strength and can be easily manufactured into a start air tube 21 of a small pore size and a small wall thickness, That is, the tube diameter of the start air tube 21 can be made less than or equal to 2.0 mm, and the wall thickness of the start air tube 21 can be made less than or equal to 0.5 mm.

The tube diameter of the start air tube 21 is greater than or equal to 0.6 mm and less than or equal to 2.0 mm, and the wall thickness of the start air tube 21 is greater than or equal to mm and less than or equal to 0.3 mm. The start air tube 21 is independently arranged and made of a metal tube. The start air tube 21 can be easily made into a size that a start airway in the existing solutions cannot reach. Because of the high strength of the start air tube 21, the wall thickness can also be made small, so that the start air tube 21 occupies less space of the liquid storage cavity 102.

The tube diameter of the start air tube 21 may be 0.6 mm, 0.8 mm, 1.0 mm, 1.2 mm, 1.4 mm, 1.6 mm, 1.8 mm, or 2.0 mm. The wall thickness of the start air tube 21 may be 0.1 mm, 0.12 mm, 0.14 mm, 0.16 mm, 0.18 mm, 0.2 mm, 0.22 mm, 0.24 mm, 0.26 mm, 0.28 mm, or 0.3 mm.

Optionally, the start air tube 21 may also be a high-strength plastic tube or the like, which is not specifically limited in this application.

Figure 4:
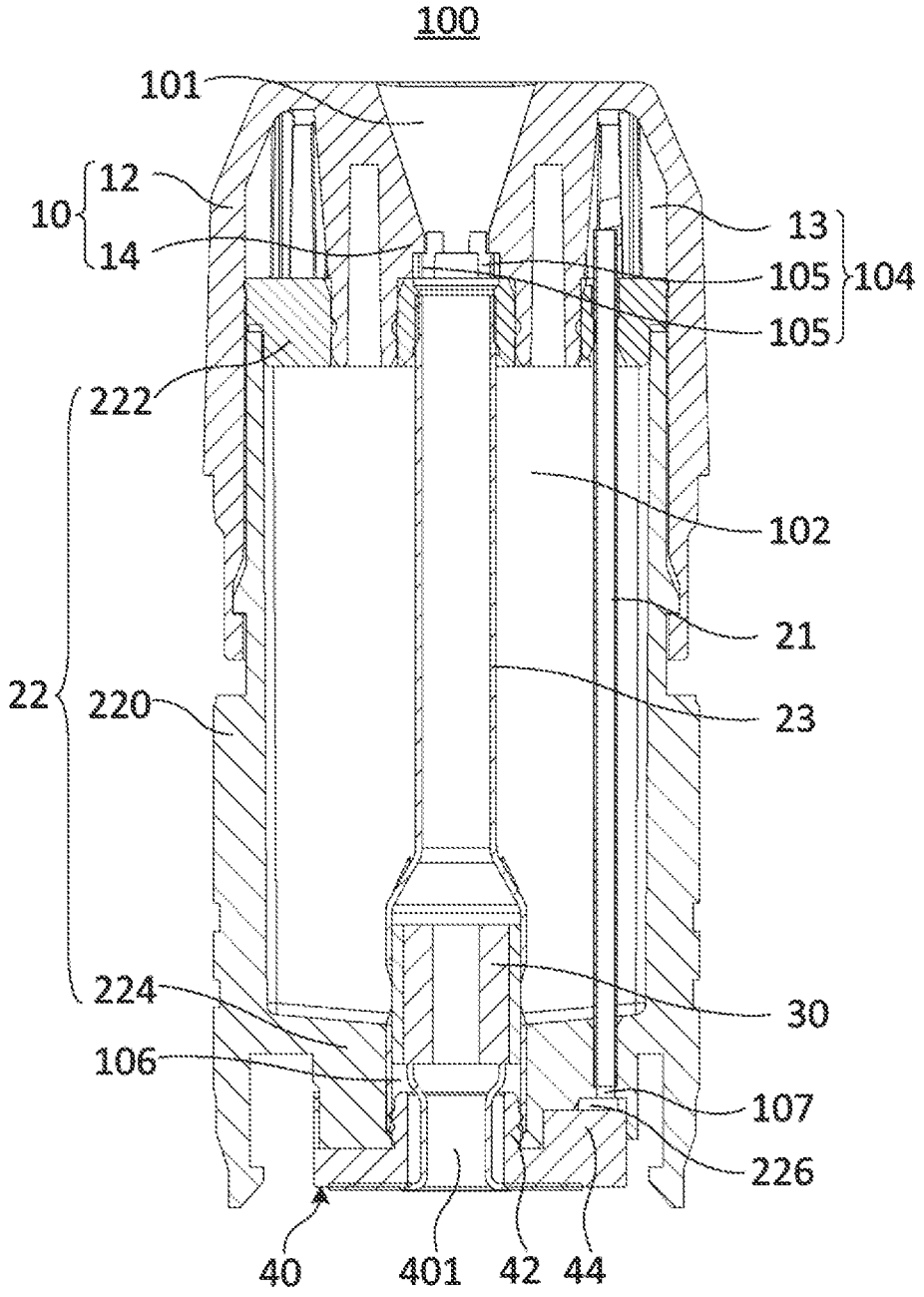
FIG. 4 is a schematic cross-sectional structural view of a vaporizer in the electronic vaporization device shown in FIG. 2.

Reference may be made to FIG. 2 to FIG. 4 in combination. FIG. 4 is a schematic cross-sectional structural view of a vaporizer in the electronic vaporization device shown in FIG. 2.

In this embodiment, the vaporizer 100 includes a suction nozzle 10, a shell 22, a vaporization air tube 23, and a start air tube 21. The two ends of the vaporization air tube 23 are correspondingly connected to the two ends of the shell 22. The start air tube 21 is detachably connected to the two ends of the shell 22, and both the vaporization air tube 23 and the start air tube 21 pass through the liquid storage cavity 102 of the shell 22. The vaporization air tube 23 is provided with an inhalation channel 103 communicating with the suction nozzle opening 101. The suction nozzle 10 is provided with the suction nozzle opening 101, the suction nozzle 10 is connected to the shell 22, the suction nozzle opening 101 is in communication with the vaporization air tube 23, and the suction nozzle 10 and an end of the shell 22 form a communication airway 104, and the communication airway 104 communicates with the vaporization air tube 23 and the end of the start air tube 21 close to the suction nozzle 10.

The suction nozzle 10 is detachably connected to the shell 22, for example, in a clamped connection manner, in a screwed connection manner, or by a fastener. The fastener may be a screw, a pin, or the like. In addition, after the connection is completed, the communication airway 104 is jointly formed, so that the vaporization air tube 23 communicates with the end of the start air tube 21 close to the suction nozzle 10 through the communication airway 104.

Optionally, the suction nozzle 10 may also be connected to the shell 22 in a non-detachable connection manner such as welding, bonding, or hot-column hot-melt connection.

The vaporization air tube 23 may also be connected to the shell 22 detachably or non-detachably, which is not limited in this application.

As shown in FIG. 4, the suction nozzle 10 includes a first housing 12 and a second housing 14 arranged on the inner side of the first housing 12, a cavity 13 is formed between the first housing 12 and the second housing 14, the second housing 14 is provided with the suction nozzle opening 101, and at least one transition opening 105 communicating with the cavity 13 and the suction nozzle opening 101 is formed at the end of the second housing 14 and/or the shell 22 close to the suction nozzle opening 101. The first housing 12 is detachably connected to the shell 22, and an end of the shell 22 covers the cavity 13, to define and form the communication airway 104. The end of the start air tube 21 close to the suction nozzle opening 101 extends into the cavity 13.

That is, the suction nozzle 10 is a shell structure, which can be manufactured by injection molding or die-casting. The communication airway 104 includes the cavity 13 and the transition opening 105. In another implementation, the communication airway 104 may be a groove structure or a hole structure on the suction nozzle 10. The first housing 12 and the second housing 14 may also be manufactured independently, and then be connected to form the suction nozzle 10, which is not specifically limited in this application.

As shown in FIG. 4, the shell 22 includes a barrel portion 220 and a first end portion 222 and a second end portion 224 respectively connected to the two ends of the barrel portion 220. At least one of the first end portion 222 or the second end portion 224 and the barrel portion 220 is detachably connected to barrel portion 220, and defines the liquid storage cavity 102.

In this embodiment, the vaporization air tube 23 is detachably connected to the two ends of the shell 22. After the vaporization air tube 23 and the start air tube 21 pass through the liquid storage cavity 102 and connect to the first end portion 222 or second end portion 224, one of the first end portion 222 or second end portion 224 that can be detachably arranged is further connected to the other end of the vaporization air tube 23 and the other end of the start air tube 21 and the barrel portion 220, thereby avoiding that the vaporization air tube 23 and the start air tube 21 are connected to the shell 22 out of the field of view. In addition, because the operation of the connection is difficult, limiting that at least one of the first end portion 222 or second end portion 224 is detachably connected to the barrel portion 220 can effectively improve the convenience of connecting the vaporization air tube 23 and the start air tube 21 to the shell 22, thereby reducing the difficulty of assembly and improving the efficiency of assembly.

In this embodiment, the first end portion 222 is arranged relatively close to the suction nozzle opening 101, and the first end portion 222 is detachably connected to the barrel portion 220. The second end portion 224 is integrally connected to the barrel portion 220. The first end portion 222 is made of a sealing material and further forms a seal structure together with the barrel portion 220 and the suction nozzle 10, to prevent liquid leakage.

The first end portion 222 is covered on the end of the barrel portion 220 facing toward the suction nozzle opening 101, and the vaporization air tube 23 and the end of the start air tube 21 close to the suction nozzle opening 101 are inserted into the first end portion 222 and cooperate with the first end portion 222 in a sealed manner.

In this embodiment, the start air tube 21 is connected to the two ends of the shell 22 in an interference-fit manner, that is, the two ends of the start air tube 21 are respectively connected to the first end portion 222 and the second end portion 224 in an interference-fit manner, which makes the disassembly and assembly convenient and can also prevent liquid linkage at the joints between the start air tube 21 and the first end portion 222 and the second end portion 224.

Optionally, the start air tube 21 is connected to the two ends of the shell 22 in a screwed connection manner. Such a connection manner also has the functions of making disassembly and assembly convenient and preventing liquid linkage.

The vaporization air tube 23 may also be connected to the ends of the shell 22 in the same manner as the start air tube 21.

The inhalation channel 103 includes a pipeline of the vaporization air tube 23, and the pipeline of the vaporization air tube 23 can form a part of the inhalation channel 103, and can also form the whole of the inhalation channel 103. If the vaporization core 30 is arranged in the inhalation channel 103, then the vaporization core 30 may be accommodated in the vaporization air tube 23, or the vaporization core 30 is at least partially accommodated in the vaporization air tube 23, or the vaporization core 30 may also be arranged outside the vaporization air tube 23 provided that the inhalation channel 103 passes through the vaporization core 30. The specific installation position and mechanism of the vaporization core 30 are not specifically limited in this application.

In this embodiment, the vaporization core 30 is accommodated in the vaporization air tube 23, and the vaporization air tube 23 is provided with a liquid inlet hole communicating with the liquid storage cavity 102. The vaporization core 30 absorbs liquid from the liquid storage cavity 102 through the liquid inlet hole, and vaporizes the liquid in the inhalation channel 103, so that the airflow in the inhalation channel 103 can take away the aerosol generated by the vaporization in time during inhalation of a user.

Referring to FIG. 4, the transition opening 105 may be arranged on the second housing 14 and/or the first end portion 222.

For example, the transition opening 105 is a hole structure on the second housing 14. Alternatively, the transition opening 105 is a notch structure arranged on the second housing 14. The opening side of the notch structure is abutted against the first end portion 222, so that gas-liquid substances entering the cavity 13 due to various factors can pass through the notch structure after condensation to enter the vaporization air tube 23, and can be absorbed and vaporized by the vaporization core 30. Alternatively, the transition opening 105 is a groove structure arranged on the first end portion 222. One end of the groove structure is in communication with the cavity 13, and the other end of the groove structure is in communication with the suction nozzle opening 101 and the vaporization air tube 23, which helps to guide liquid accumulated in the cavity 13 to the vaporization air tube 23.

External water vapor or aerosol flowing through the inhalation channel 103 inevitably enters into the cavity 13. There is a risk that the gas-liquid substances enter the start air tube 21 after condensation in the cavity 13. Therefore, limiting the position of the transition opening 105 helps to discharge liquid in the cavity 13 in time, so as to lower the risk of that the start air tube 21 fails because liquid enters the start air tube 21.

Further, with reference to FIG. 3 and FIG. 4, the end surface of the end of the start air tube 21 close to the suction nozzle opening 101 is higher than the end surface of the end of the shell 22 close to the suction nozzle opening 101, and the end surface of the end of the start air tube 21 close to the suction nozzle opening 101 is higher than the end surface of the first end portion 222. Therefore, there is a height difference between a port of the end of the start air tube 21 close to the suction nozzle opening 101 and the end surface of the first end portion 222, so that when there is liquid (for example, condensate) accumulated on the end surface of the first end portion 222, the risk that liquid enters the start air tube 21 can be lowered, that is, the risk that the start air tube 21 fails because liquid enters the start air tube 21 can be lowered.

The height difference H between the end surface of the end of the start air tube 21 close to the suction nozzle opening 101 and the end surface of the end of the shell 22 close to the suction nozzle opening 101 is greater than or equal to 0.1 mm, which can effectively lower the risk that the start air tube 21 fails because liquid enters the start air tube 21.

Optionally, the height difference H may be 0.1 mm, 0.2 mm, 0.3 mm, 0.4 mm, 0.5 mm, mm, 0.7 mm, 0.8 mm, 0.9 mm, 1.0 mm, 2.1 mm, or the like.

Figure 5:
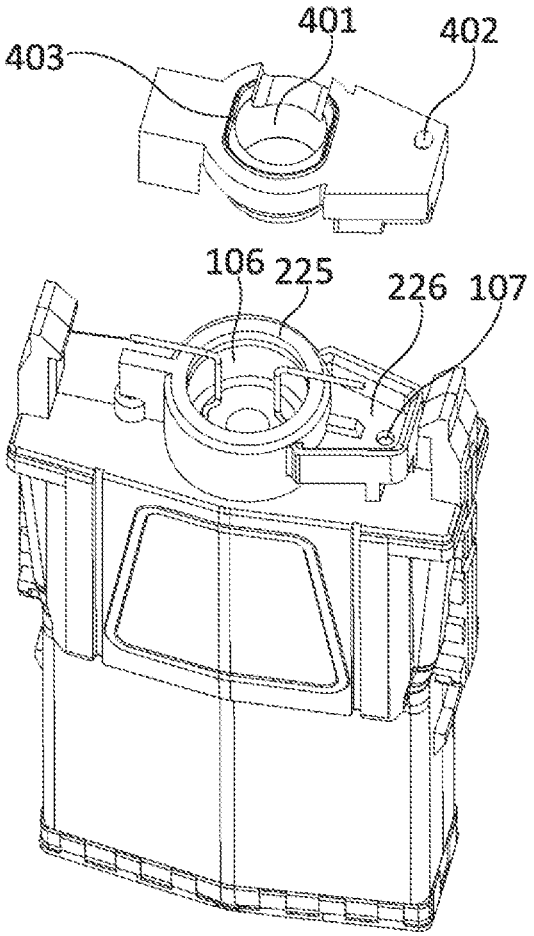
FIG. 5 is a schematic exploded structural view of an elastic base and a liquid storage tank in the vaporizer shown in FIG. 4.

Further, reference may be made to FIG. 4 and FIG. 5 in combination. FIG. 5 is a schematic exploded structural view of an elastic base and a liquid storage tank in the vaporizer shown in FIG. 4.

The vaporizer 100 further includes an elastic base 40, the elastic base 40 is provided with a first vent hole 401 and a second vent hole 402 that are isolated from each other, the elastic base 40 is connected to the end of the shell 22 far away from the suction nozzle opening 101, the first vent hole 401 is in communication with the port of the vaporization air tube 23 far away from the suction nozzle opening 101, and the second vent hole 402 is in communication with the port of the start air tube far 21 away from the suction nozzle opening 101. The end of the elastic base facing away from the suction nozzle opening 101 is elastically abutted against the main unit 200, to isolate the first vent hole 401 and the second vent hole 402.

After the vaporizer 100 is connected to the main unit 200, the elastic base 40 is abutted against the main unit 200, so that the end of the second vent hole 402 far away from the start air tube 21 communicates with the start switch 201.

The end of the first vent hole 401 away from the vaporization air tube 23 is in communication with the external atmosphere. The first vent hole 401 may communicate with the external atmosphere through a holder on the main unit 200, or may directly communicate with the external atmosphere directly through the opening of the housing in the main unit 200.

The elastic base 40 forms elastic sealing by receiving the clamping forces from both sides after the vaporizer 100 is connected to the main unit 200, so as to isolate the first vent hole 401 and the second vent hole 402 from each other, thereby preventing liquid leakage or the like that possibly exists in the inhalation channel 103 from damaging the start switch 201.

Further, at least one isolation rib 403 is arranged at the end of the elastic base 40 facing away from the suction nozzle opening 101, and the isolation rib 403 is arranged around at least one of the first vent hole 401 or the second vent hole 402.

There is one isolation rib 403, which can be arranged around one of the first vent hole 401 or the second vent hole 402. Alternatively, there are two isolation ribs 403. The two isolation ribs 403 are arranged around the first vent hole 401 and the second vent hole 402 respectively.

After the vaporizer 100 is connected to the main unit 200, the isolation rib 403 protrudes relative to an end surface of the elastic base 40. Therefore, the effect that the vaporizer 100 is abutted against and sealed with the main unit 200 are better, so that the effect of isolating the first vent hole 401 and the second vent hole 402 is better.

The elastic base 40 is connected to the second end portion 224, the second end portion 224 is provided with an air inlet hole 106, the vaporization air tube 23 is in communication with the air inlet hole 106, and the first vent hole 401 is also in communication with the air inlet hole 106. The second end portion 224 is further provided with an insertion hole 107 that is in interference fit with the start air tube 21.

Figure 6:
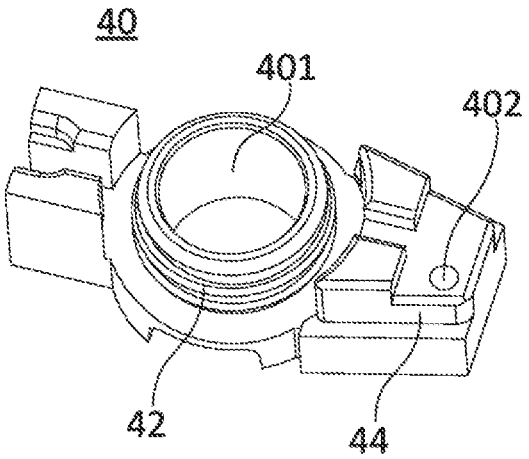
FIG. 6 is a schematic structural diagram of an elastic base in the vaporizer shown in FIG. 5.

Specifically, reference may be made to FIG. 4 to FIG. 6. FIG. 6 is a schematic structural diagram of an elastic base in the vaporizer shown in FIG. 5. The end of the shell 22 far away from the suction nozzle opening 101 is provided with a sleeve portion 225 and an accommodating groove 226 arranged on one side of the sleeve portion 225. That is, the second end portion 224 includes the sleeve portion 225 and the accommodating groove 226 arranged on one side of the sleeve portion 225. The sleeve portion 225 is provided with an air inlet hole 106, and the insertion hole 107 is also in communication with the accommodating groove 226.

One end of the vaporization air tube 23 is connected to the inside of the sleeve portion 225, that is, the vaporization air tube 23 is connected to the air inlet hole 106, and one end of the start air tube 21 is connected to the insertion hole 107 and communicates with the accommodating groove 226.

The elastic base 40 includes a sealing sleeve 42 and an accommodating portion 44 connected to a side of the sealing sleeve 42, the sealing sleeve 42 is provided with the first vent hole 401, the sealing sleeve 42 extends into the sleeve portion 225 and is arranged and sealed with the inner wall of the vaporization air tube 23 and the inner wall of the sleeve portion 225, to prevent liquid leakage at the joint between the vaporization air tube 23 and the air inlet hole 106. The accommodating portion 44 is provided with the second vent hole 402, and at least a part of the accommodating portion 44 is accommodated in the accommodating groove 226 and is arranged and sealed with the groove walls of the accommodating groove 226, so as to cover the accommodating groove 226. Further, the start air tube 21 communicates with the second vent hole 402 through the accommodating groove 226. The accommodating groove 226 may be used as a liquid collection trough to collect liquid that enters the start air tube 21 by mistake, so as to prevent the liquid from flowing directly into the start switch 201 and causing the start switch 201 to fail, thereby further lowering the risk that the start switch 201 fails.

Further, the port of the start air tube 21 facing toward the accommodating groove 226 and the port of the second vent hole 402 facing toward the accommodating groove 226 are arranged in a staggered manner, which can prevent liquid from falling directly into the second vent hole 402 when there is liquid in the start air tube 21. Therefore, the liquid can be collected in the accommodating groove 226, which helps to reduce the risk that the start switch 201 fails.

Different from the related art, this application discloses a vaporizer and an electronic vaporization device. In this application, an independent start air tube passing through a liquid storage cavity is arranged, to form a start airway that is not shared with an inhalation channel, to prevent that a vaporizer cannot be started after the inhalation channel is blocked. In addition, the end of the start air tube close to a suction nozzle opening is in communication with the end of the inhalation channel close to the suction nozzle opening, that is, the start air tube is also in direct communication with the suction nozzle opening. Moreover, this part is located on the side of the liquid storage cavity close to the suction nozzle opening, and being close to the suction nozzle opening prevents the position from being easily blocked by aerosol condensate. Therefore, even if the inhalation channel is blocked, during inhalation, a user can still start the vaporizer through the start air tube for heating. After the heating is started, a vaporization core inside the inhalation channel heats up for vaporization, which can reduce the viscosity of a vaporizable substrate that blocks the inhalation channel to make the vaporizable substrate flow away or vaporized. Therefore, the bad situation that inhalation channel is blocked can be eliminated, to enable the vaporizer to return to normal and continue to be used, thereby improving the reliability of the vaporizer. In addition, compared with the existing solution that a liquid storage cavity, a inhalation channel, and a start airway are directly formed on a housing of vaporizer, this application defines that the start air tube is detachably arranged, that is, the start air tube can be independently manufactured as a separate component, so that the start air tube can be miniaturized, which can significantly reduce the manufacturing difficulty of other components in the vaporizer and improve the yield rate of the vaporizer. In addition, the miniaturized start air tube occupies less space in the liquid storage cavity, and has less impact on the capacity of the liquid storage cavity.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a shell comprising a liquid storage cavity;

a suction nozzle comprising a suction nozzle opening, the suction nozzle being connected to the shell;

a vaporization air tube passing through the liquid storage cavity and comprising an inhalation channel in communication with the suction nozzle opening; and a start air tube passing through the liquid storage cavity, the start air tube being detachably arranged, an end of the start air tube close to the suction nozzle opening being in communication with an end of the inhalation channel close to the suction nozzle opening, wherein an end of the inhalation channel far from the suction nozzle opening is in communication with external atmosphere, wherein an end of the start air tube far from the suction nozzle opening is configured to communicate with a pneumatic switch on a main unit of an electronic vaporization device, wherein the start air tube is in communication with a channel of the pneumatic switch and is isolated from a channel of the inhalation channel in communication with the external atmosphere, wherein the two ends of the vaporization air tube are connected to the two ends of the shell, respectively, the start air tube being detachably connected to the two ends of the shell, wherein the suction nozzle and an end of the shell form a communication airway in communication with the vaporization air tube and the end of the start air tube close to the suction nozzle opening, wherein the start air tube is connected to the two ends of the shell in an interference-fit manner, or wherein the start air tube is connected to the two ends of the shell in a screwed connection manner, and wherein an end surface of the end of the start air tube close to the suction nozzle opening is higher than an end surface of the end of the shell close to the suction nozzle opening.

2. The vaporizer of claim 1, wherein the start air tube comprises a metal tube.

3. The vaporizer of claim 1, wherein a tube diameter of the start air tube is greater than or equal to 0.6 mm and less than or equal to 2.0 mm, and wherein a wall thickness of the start air tube is greater than or equal to 0.1 mm and less than or equal to 0.3 mm.

4. The vaporizer of claim 1, wherein a height difference between the end surface of the end of the start air tube close to the suction nozzle opening and the end surface of the end of the shell close to the suction nozzle opening is greater than or equal to 0.1 mm.

5. The vaporizer of claim 1, wherein the suction nozzle comprises a first housing and a second housing arranged on an inner side of the first housing, a cavity being formed between the first housing and the second housing, the second housing being provided with the suction nozzle opening, wherein at least one transition opening communicating with the cavity and the suction nozzle opening is formed at an end of the second housing and/or the shell close to the suction nozzle opening, wherein the first housing is detachably connected to the shell, and an end of the shell covers the cavity, to define and form the communication airway, and wherein an end of the start air tube close to the suction nozzle opening extends into the cavity.

6. The vaporizer of claim 1, further comprising an elastic base provided with a first vent hole and a second vent hole that are isolated from each other, the elastic base being connected to an end of the shell far from the suction nozzle opening, wherein the first vent hole is in communication with a port of the vaporization air tube far from the suction nozzle opening, and the second vent hole is in communication with a port of the start air tube far from the suction nozzle opening, and wherein an end of the elastic base facing away from the suction nozzle opening is elastically abutted against the main unit to isolate the first vent hole and the second vent hole.

7. The vaporizer of claim 6, wherein at least one isolation rib is arranged at the end of the elastic base facing away from the suction nozzle opening, the isolation rib being arranged around at least one of the first vent hole or the second vent hole.

8. The vaporizer of claim 6, wherein a sleeve portion and an accommodating groove arranged on one side of the sleeve portion are arranged at the end of the shell facing away from the suction nozzle opening, the end of the vaporization air tube being connected to an inner side of the sleeve portion, the end of the start air tube being in communication with the accommodating groove, wherein the elastic base comprises a sealing sleeve and an accommodating portion connected to a side of the sealing sleeve, the sealing sleeve being provided with the first vent hole, the accommodating portion being provided with the second vent hole, the sealing sleeve extending into the sleeve portion and being arranged and sealed with the inner wall of the vaporization air tube and the inner wall of the sleeve portion, and wherein at least a part of the accommodating portion is accommodated in the accommodating groove and is arranged and sealed with groove walls of the accommodating groove.

9. An electronic vaporization device, comprising:

a main unit; and the vaporizer of claim 1, wherein the main unit is connected to the vaporizer to make an end of the start air tube far away from the suction nozzle opening in communication with the pneumatic switch on the main unit.

* * * * *